US006916258B2

(12) United States Patent
Dadbeh

(10) Patent No.: US 6,916,258 B2
(45) Date of Patent: Jul. 12, 2005

(54) COLLAPSIBLE TENNIS TABLE ASSEMBLY AND BASE

(75) Inventor: Bemanali H. Dadbeh, Encinitas, CA (US)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 10/609,858

(22) Filed: Jun. 30, 2003

(65) Prior Publication Data

US 2004/0266568 A1 Dec. 30, 2004

(51) Int. Cl.[7] ..... A63B 67/04
(52) U.S. Cl. ..... 473/496
(58) Field of Search ..... 473/496; 16/29 R, 16/31 R, 31 A, 18 R; 280/32.6; 108/177, 178

(56) References Cited

U.S. PATENT DOCUMENTS

| | | | | | |
|---|---|---|---|---|---|
| 1,853,007 | A | * | 4/1932 | Stannard | 280/32.6 |
| 3,559,592 | A | * | 2/1971 | Closa | 108/102 |
| 3,830,495 | A | * | 8/1974 | Hill | 473/496 |
| 4,077,333 | A | * | 3/1978 | Ballas | 108/6 |
| 5,733,211 | A | * | 3/1998 | Dupre | 473/496 |
| 5,816,957 | A | | 10/1998 | Dadbeh | |
| 6,014,936 | A | * | 1/2000 | Rogers et al. | 108/167 |

OTHER PUBLICATIONS

"2002 Product Catalog", pp. 4, 5, 6 and 7, Escalade Sports, Evansville, Indiana.

* cited by examiner

*Primary Examiner*—Raleigh W. Chiu
(74) *Attorney, Agent, or Firm*—Woodard, Emhardt, Moriarty McNett & Henry LLP

(57) ABSTRACT

In preferred features, table tennis tables of the present invention include a caster base assembly which improves the ease of use and stability of the table tennis table. Preferably the table includes two caster base members adjacent opposing sides of the table. Each caster base member is preferably formed from a substantially horizontal elongate piece, preferably tubular, having two opposing end portions and a middle portion. Extending downward and mounted adjacent each opposing end is a caster which typically rests upon a support surface. The middle portion of the base member preferably has a lower height than the opposing end portions. When the table is assembled, the leg structure for a table portion of the table tennis table is attached to the base member adjacent an end portion. A cross-member may optionally be attached between the base members. In one preferred embodiment, the tennis table of the present invention comprises two table sections, each table section including tubular leg portions secured to the bottom (non-player) surface of each table portion. The caster base assembly includes vertically extending tubular extensions, preferably with swaged or reduced diameter ends, which are adapted to be joined with the ends of two leg portions. When joined in this manner, an assembled tennis table is provided. The casters allow the assembled tennis table to be easily moved about. When it is desired to play table tennis, each table section is moved to the horizontal position.

12 Claims, 6 Drawing Sheets

COLLAPSIBLE TENNIS TABLE ASSEMBLY AND BASE

FIELD OF THE INVENTION

The present invention relates to a table tennis table and base assembly, and specifically to a collapsible table tennis table.

BACKGROUND OF THE INVENTION

Collapsible or foldable tennis tables are well known. Many of these are designed with wheels or casters to facilitate movement. The opening and closing of the table often requires a number of steps such as locking, unlocking, lifting and lowering of the table portions. These steps must be taken in a precise sequence. If the sequence is missed, it can cause serious injury to the user and/or damage property. Many of the prior art collapsible tables have a high, sometimes unstable profile and require a relatively tall person with some physical strength to open and close the table, taking extra space and making it difficult, if not impractical, for a young child or a chair-bound handicapped person to operate the table.

What is thus desired is to provide a collapsible table which is easy to assemble, is relatively inexpensive and which enables a young person or handicapped people to safely move and/or open and collapse the table. Features of certain embodiments of the present invention address these and other needs.

SUMMARY OF THE INVENTION

Preferred embodiments of the present invention provide table tennis tables that are collapsible into a relatively small profile or configuration for shipment or storage purposes. The tables are relatively stable and are capable of being opened and closed with a relatively small amount of force. Preferably the tables have a low profile, both in height and lengthwise, in both the disassembled and operational modes. A table is configured so that it is relatively easy to be operated by a young person and physically restricted persons.

In preferred features, table tennis tables of the present invention include a caster base assembly which improves the ease of use and stability of the table tennis table. Preferably the table includes two abutting table portions and two caster base members corresponding to opposing ends of the table portion abutment. Each caster base member is preferably formed from a substantially horizontal elongate piece, preferably tubular, having two opposing end portions and a middle portion. Extending downward and mounted adjacent each opposing end is a caster which typically rests upon a support surface to support the end portions at a height above the support surface. The middle portion of the base member preferably has a lower height than the opposing end portions. When the table is assembled, the leg assembly mounted to a table portion of the table tennis table is attached to the base member adjacent an end portion. A cross-member may optionally be attached between the base members.

In one preferred embodiment, the tennis table of the present invention comprises two table half assemblies, each assembly including at least two tubular leg portions secured to the bottom (non-player) surface of a table portion. The caster base assembly includes vertically extending tubular extensions mounted at the opposing end portions, preferably with swaged or reduced diameter ends which are adapted to be joined with the ends of two leg portions from each half assembly. When joined in this manner, an assembled tennis table is provided. The casters allow the assembled tennis table to be easily moved about. When it is desired to play table tennis, each table section is moved to the horizontal position.

Objects and advantages of preferred embodiments of the present invention will become clear from the following drawings and description.

DESCRIPTION OF PREFERRED EMBODIMENTS

While the invention has been described with reference to certain preferred embodiments, it will be understood by those skilled in the art that various changes may be made and equivalents may be substituted for elements thereof without departing from the true spirit and scope of the invention. Each embodiment of the present invention is not required to have every feature described herein. In addition, many modifications may be made to specific features to adapt a particular situation or material to the teaching of the invention without departing from its essential teachings.

Preferred embodiments of the present invention provide a table tennis table that is collapsible into a relatively small profile or configuration for shipment or storage purposes. In preferred features of certain embodiments, a table tennis table of the present invention includes a caster base assembly which improves the ease of use and stability of the table tennis table.

Figure 1:
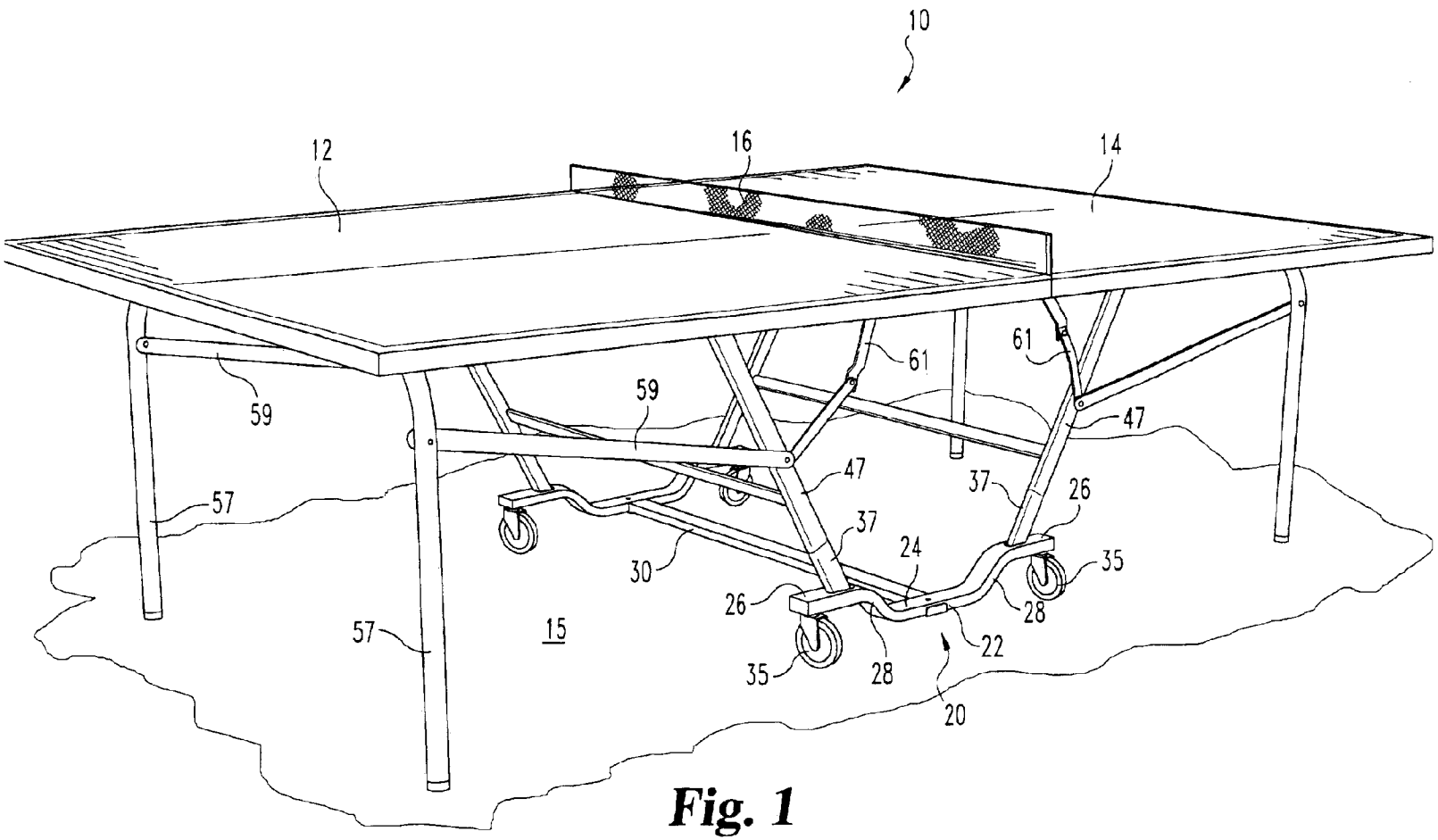
FIG. 1 is a perspective view of one preferred embodiment of the present invention.
Figure 2:
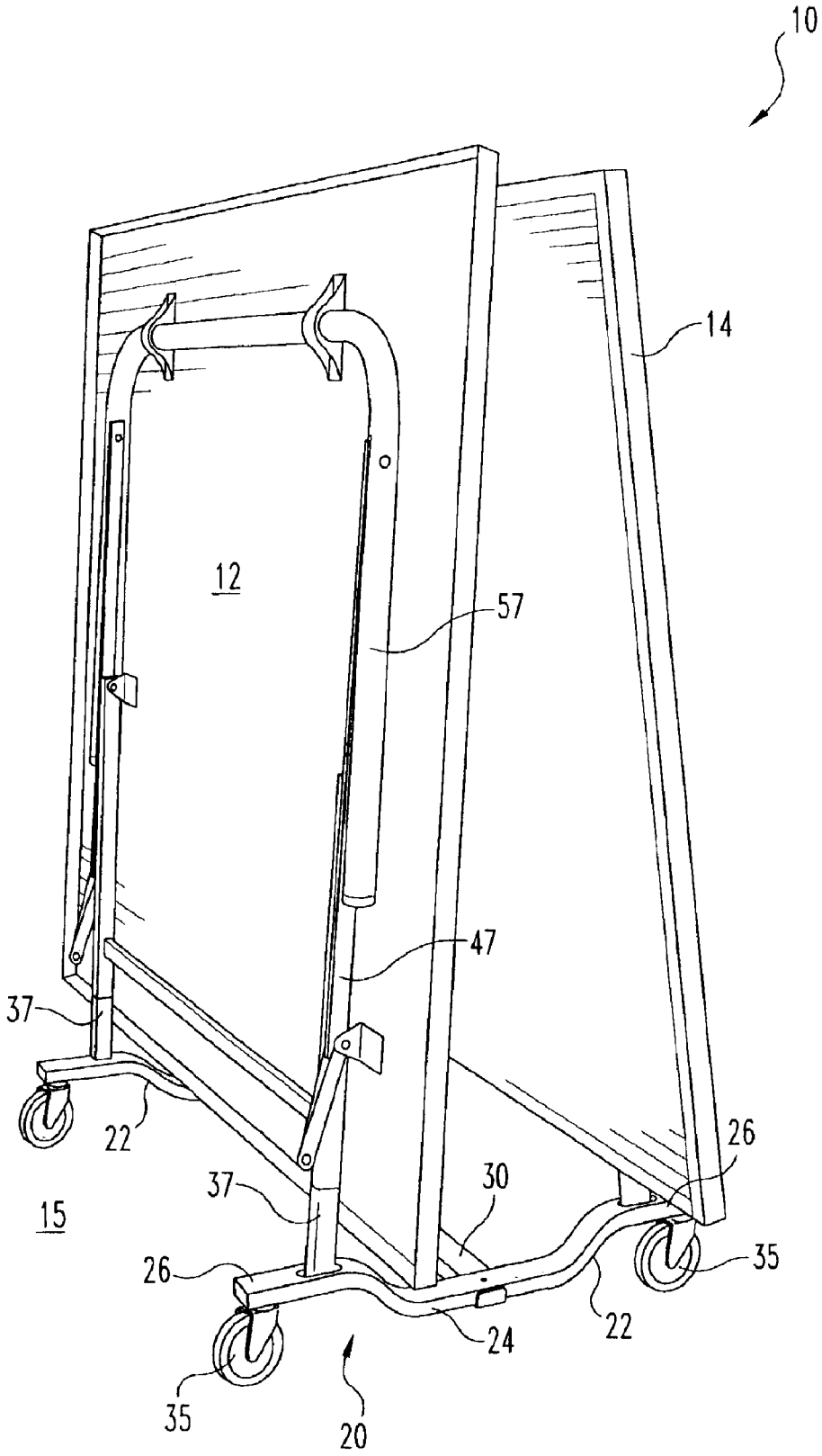
FIG. 2 is a perspective view of the preferred embodiment of FIG. 1 in a storage configuration.
Figure 3:
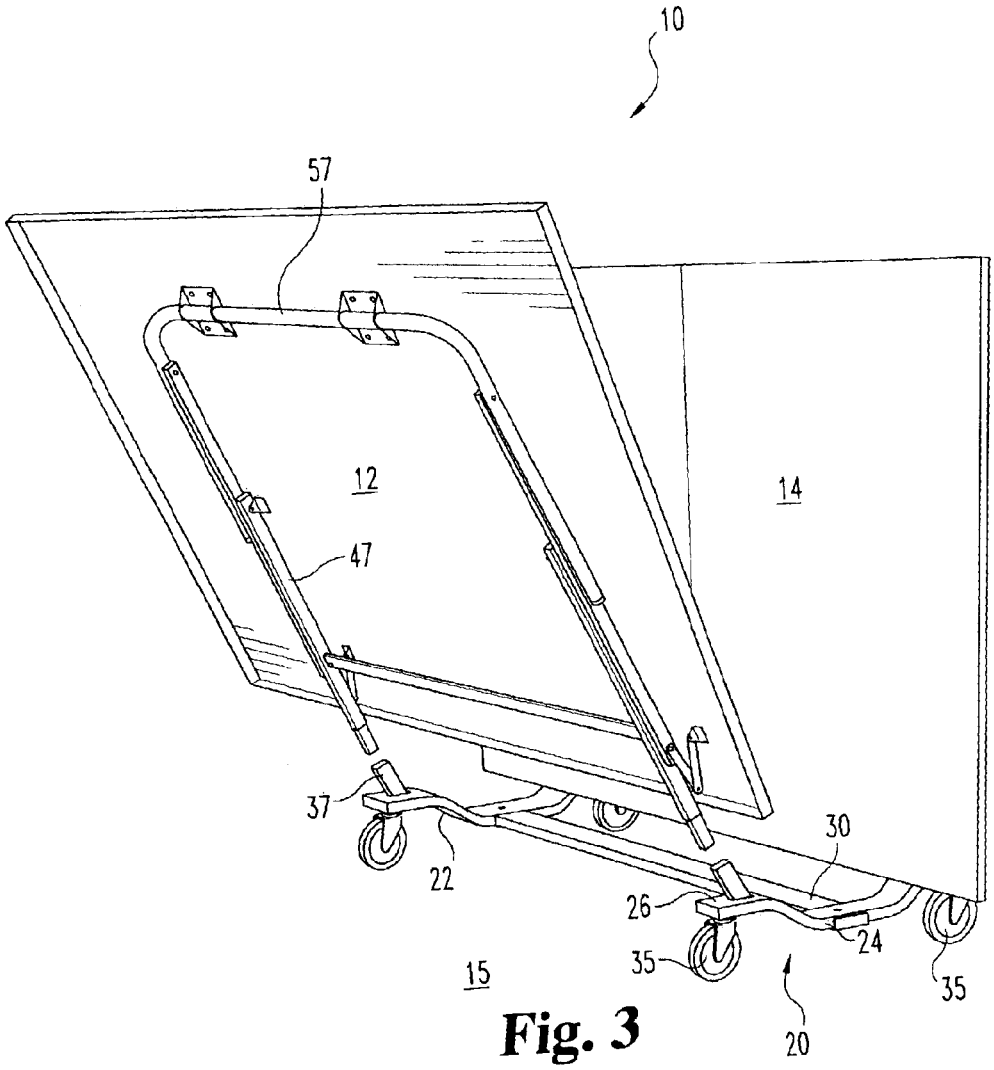
FIG. 3 is a partially exploded view of the embodiment of FIG. 1.

One example of a preferred embodiment of the present invention is illustrated in FIGS. 1–3. Table tennis table 10 is illustrated on a support surface 15 such as a floor. The table 10 includes first and second table portions 12 and 14 configured to abut in the middle, where a net 16 is typically mounted. In an alternate embodiment (not shown) table portions 12 and 14 are each formed of two pieces connected to form a table half. Each table assembly half includes a table half (12 or 14) and a leg assembly mounted to the underside which connects to a caster assembly 20. The leg assemblies and caster assembly cooperate to support table 10 upon support surface 15.

Caster assembly 20 may be considered as one unitary assembly, two separate assemblies or two assemblies connected by a cross-beam. Preferably caster assembly 20 includes at least one caster beam 22, and preferably a pair of caster-beams 22. In one embodiment, caster beam 22 is an elongate, substantially horizontal tubular piece. Preferably caster beams 22 are arranged in parallel corresponding to opposing ends of the abutment between table portions 12 and 14. Each caster beam 22 includes a middle portion 24 and opposing end portions 26. In certain preferred embodiments, middle portion 24 is separated from end portions 26 by curved portions 28, for example with an "S" curve.

End portions 26 of beam 22 are configured to receive casters 35 supporting the end portions 26 at a height above support surface 15. Preferably middle portion 24 has a reduced height in comparison to end portions 26' End portions 26 are also configured to be connected to the leg assemblies of table portions 12 and 14. A pair of caster beams 22 may optionally be connected by, a cross-brace 30.

Casters 35 are typically made of plastic, wood, rubber or metal. Each caster includes a roller portion and a bracket connected to the axle of the roller and typically having a stem connected to and received in the caster beam.

As illustrated for example in FIG. 3, preferably the leg assembly of table portion 12 has two leg portions which connect to the first respective end portions of the pair of caster beams 22. Similarly, the leg assembly connected to table portion 14 connects with the opposing end portions of the caster beams. In the specific embodiment illustrated, tubular portions 37 are preferably pivotally mounted adjacent the end portions 26 of each caster beam number 22. Tubular portions 37 are adapted to matingly engage with leg portions 47 extending from the underside of a table portion. Leg portions 47 may be separate or a connected "U" shape and are connected to the table portions by brackets. In a preferred embodiment, one of tubular portion 37 and leg portion 47 has a reduced diameter end or swaged portion received within an opening in an end of the other portion, although alternate connection mechanisms, such as bolts, may be used.

The leg assemblies attached to each table portion may further include exterior legs 57 located adjacent the outer corners of each table portion. Exterior legs 57 may be separate or a one-piece "U" or "O" shape. Legs 57 are mounted by standard brackets to the underside of each table portion, and in certain preferred embodiments may include stabilizing cross-braces 59 which cooperate between leg portions 47 and legs 57 such that pivotal movement of the table portions causes legs 57 and leg portions 47 to extend or retract. Stabilizing braces 61 may also extend between any of the legs and the table portions. Legs 57 may be made of standard materials such as aluminum or steel, and, for example, are typically tubular or square in cross-section.

In operation, table 10 can be moved between an open and a storage configuration by raising and lowering the table half assemblies. When stored, preferably each table half assembly is substantially vertically aligned over the middle portions 24 of caster beams 22. Preferably, the pivotal connection of leg portions 47 to the table portions and the pivotal connection of tubular portions 37 to the caster assembly provides two pivot axes for each table assembly, allowing the table to be easily collapsed.

For example, to collapse the table the table 12 to leg 47 connection can be pivoted first, lowering the inner edge of the table portion so that the table portion is parallel to leg portions 47. Then, the combined leg portions 47 and 37 to base 20 connection is pivoted, raising the table portion to a vertical, or slightly past vertical, orientation. Preferably, the middle portions 24 of caster beams 22 assist to lower the center-of-gravity of the collapsed table, and, in certain embodiments, provide additional clearance for the collapsed table half assemblies.

Figure 4:
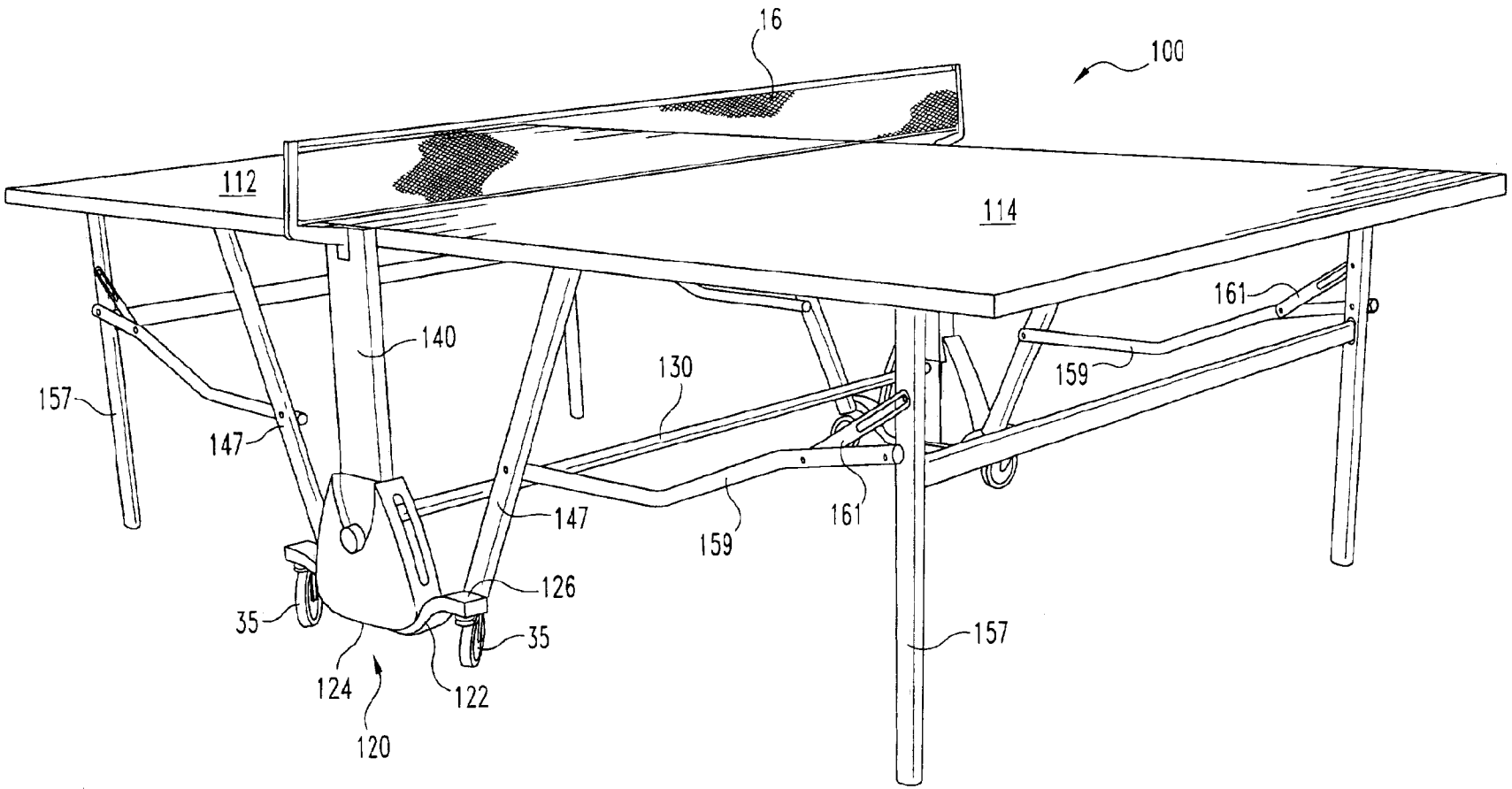
FIG. 4 is a perspective view of an alternate preferred embodiment of the present invention.
Figure 5:
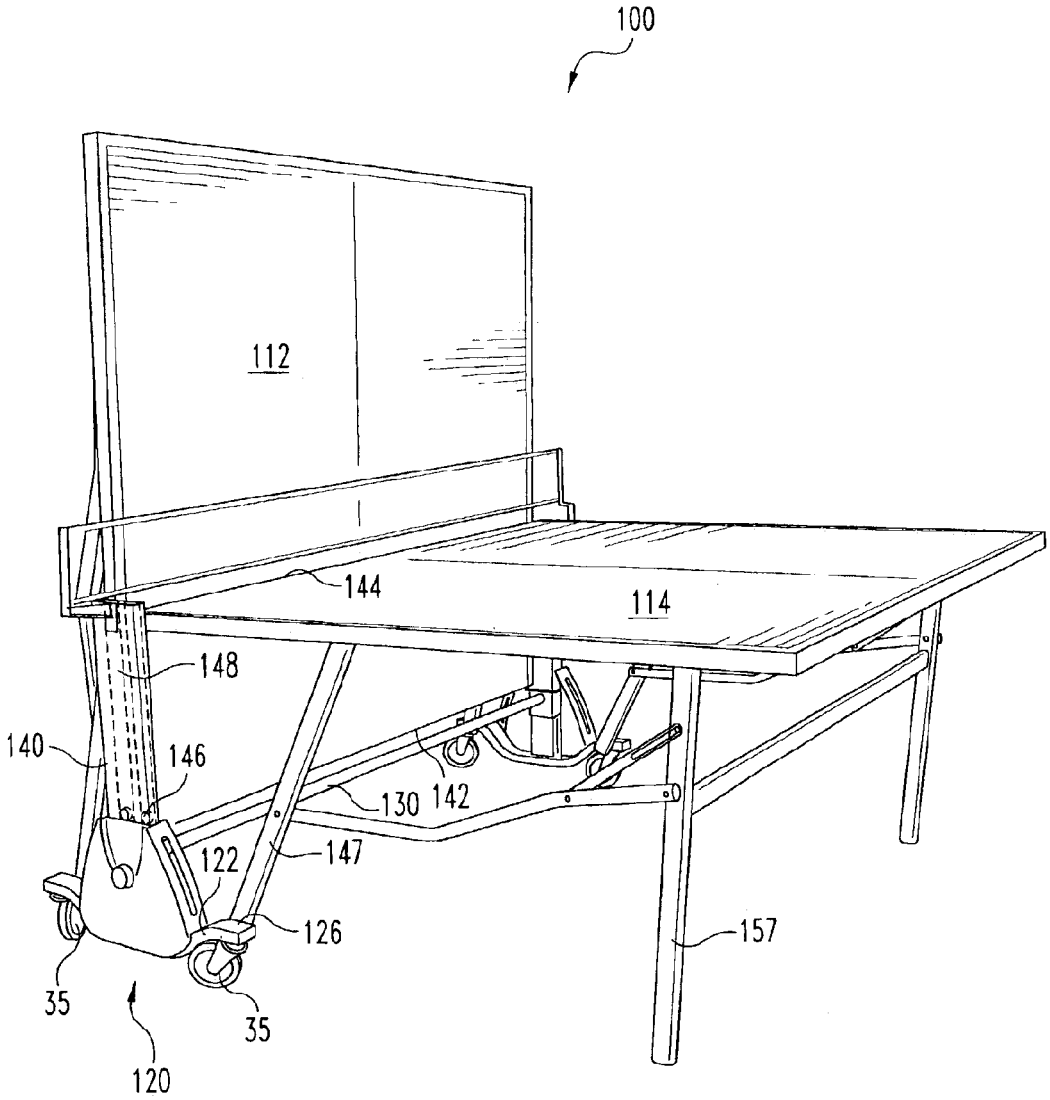
FIG. 5 is an alternate view of the embodiment of FIG. 4 in a partially stored position.
Figure 6:
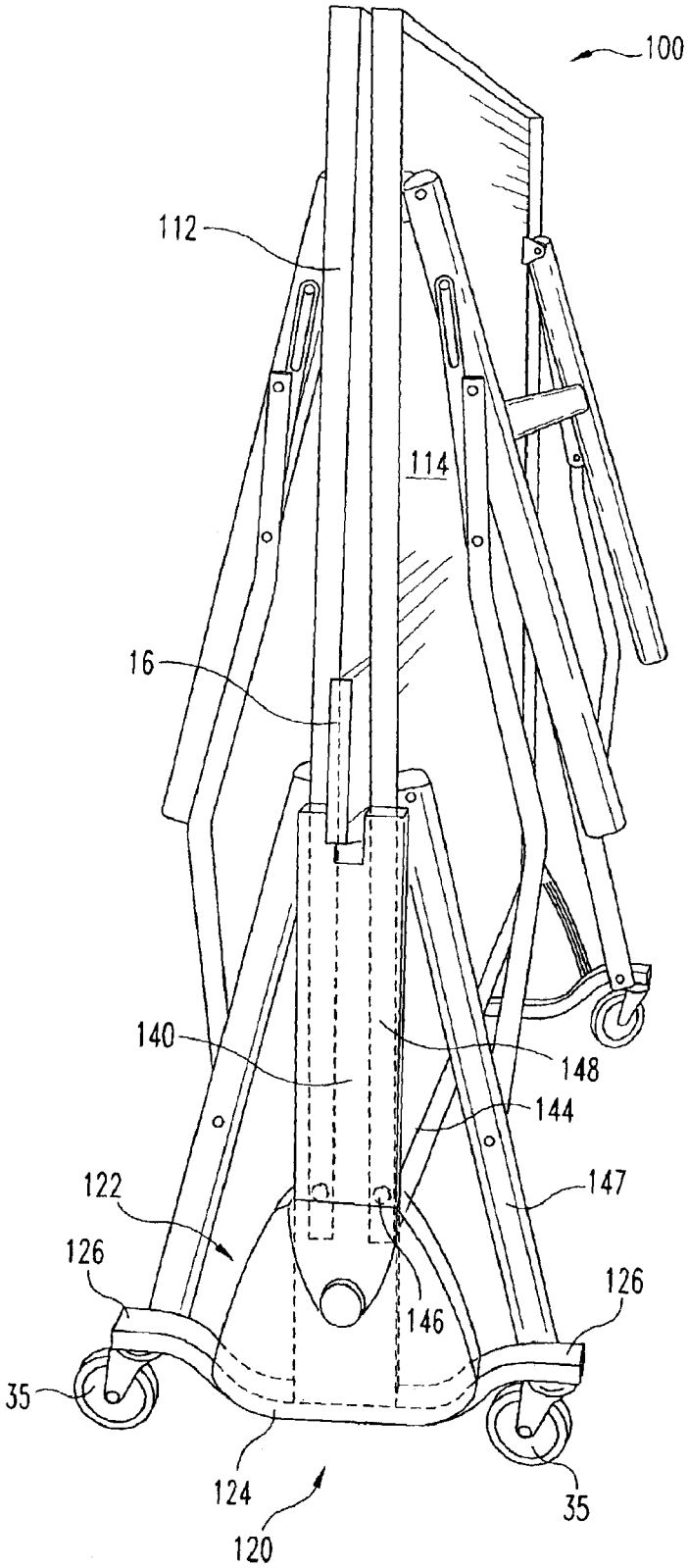
FIG. 6 is a view of the embodiment of FIG. 4 in a storage configuration.

An alternate preferred embodiment of a table tennis table 100 is illustrated in FIGS. 4–6. Table 100 includes table portions 112 and 114 and net 16, similar to those of table 10. The caster assemblies 120 for table 100 differ slightly from those of table 10. As illustrated, a pair of caster assemblies 120 are located corresponding to opposing ends of the abutment of table portions 112 and 114. Each caster assembly 120 includes a caster beam member 122 with a middle portion 124 and end portions 126. Each caster assembly further includes casters 35 and an upright beam 140 extending from the middle portion of caster beam 122 to the abutment of the inner edges 142 and 144 of the table portions. Optionally, a cross-brace 130 extends between the caster assemblies and connects to the upright members 140.

Preferably, each table portion includes rollers 146 mounted on the sides of each table portion adjacent the inner edge 142 or 144. Preferably each upright beam 140 defines two interior tracks 148 configured to receive rollers 146 and allows the rollers to roll in a vertical direction within the track as each table portion is raised and lowered.

Each table portion 112 and 114 includes a leg assembly mounted to the underside. Each leg assembly includes leg portions 147 extending from the table portion and attached to an end portion 126 of a caster beam 122, and each leg assembly further includes exterior leg portions 157 mounted adjacent the exterior corners of each table portion. The legs may be linked by cross beams 159 or braced by brackets 161. The legs may have various geometries.

Preferably when table 100 is changed from an open configuration to a storage configuration, the outer edge of the table portion is lifted while the inner edge correspondingly travels vertically along a track defined between the caster assemblies. When the table portion is moved to a vertical orientation, preferably the leg assembly is interconnected to retract parallel to the table portions, providing a thin profile for storage. As a safety measure, a latch or a safety strap may be connected between the upright table portions to minimize the risk of them opening when unintended. In one configuration of table 100, the lowered middle portion 124 of the caster beam members 122, provides clearance allowing the inner edges of each table portion to be lowered between upright beams 140 and between higher end portions 126. This allows a lower profile storage of the table in height and lowers the center of gravity of the table, providing more stability. The stored table can be moved as desired on the casters.

In the illustrated embodiments of table 100, the upright beams 140 and caster beams 122 are connected. This connection may be done by welding, bolts, brackets or similar methods known in the art. Optionally mounted to the caster assembly is a racquet holder. The racquet holder may optionally be used with the table to provide a convenient spot for storing racquets and/or table tennis balls when the table is not in use. The racquet holder may be made of plastic, metal, wood or similar durable materials.

The table portions may be wood, laminate, plastic, or fiberglass or other standard materials known in the art. Similarly, the leg assemblies are connected to the table portions with brackets and connectors as is well known in the art. Standard materials such as aluminum or steel may be used.

All publications and patent applications cited in this specification are herein incorporated by reference as if each individual publication or patent application were specifically and individually indicated to be incorporated by reference. Further, any theory, mechanism of operation, proof, or finding stated herein is meant to further enhance understanding of the present invention, and is not intended to limit the present invention in any way to such theory, mechanism of operation, proof, or finding.

While the invention has been illustrated and described in detail in the drawings and foregoing description, the same is to be considered as illustrative and not restrictive in character, it being understood that only selected embodiments have been shown and described and that all equivalents, changes, and modifications that come within the spirit of the inventions as defined herein or by the following claims are desired to be protected.

What is claimed is:

1. A table tennis table selectively movable between an open position and a storage position, comprising:

a) a caster beam member having opposing end portions and a middle portion;

b) at least one caster mounted adjacent each end portion to support the end portions of said caster beam at a height above a support surface;

c) at least first and second table portions forming a table tennis table;

d) at least first and second leg assemblies attached to said first and second table portions respectively;

e) wherein said first leg assembly extends to one end portion of said caster beam and wherein said second leg assembly extends to the opposing end portion of said caster beam;

f) wherein said middle portion of said caster beam has a lower height than said end portions;

g) an upright beam extending vertically from the middle portion of said caster beam member; and, h) wherein said table portions have at least one roller configured to be received in a track defined in said upright beam.

2. The table tennis table of claim 1 wherein said caster beam member includes curved portions between said middle portion and said opposing end portions.

3. The table tennis table of claim 2 wherein said curved portions have an "S" profile.

4. The table tennis table of claim 1 further comprising tubular portions mounted adjacent said opposing end portions of said caster beam member, wherein one end potion of each said tubular portion is configured to connect to leg portions of said first or second leg assemblies.

5. The table tennis table of claim 4 wherein one said tubular portion or said leg portion has a reduced diameter end portion configured to be received in an opening in an end of the other of said tubular portion or said leg portion.

6. The table tennis table of claim 5 wherein said tabular portions are pivotally mounted to said caster beam member.

7. The table tennis table of claim 1 wherein said leg assemblies include at least one interior leg portion configured to attach to said caster beam member and at least one exterior leg member adjacent an exterior corner of a table portion, wherein said interior leg portion and said exterior leg member are linked such that collapsing said table team an open position to a storage position causes said interior leg portion and said exterior leg member to retract parallel to a table portion.

8. A table tennis table selectively movable between an open configuration and a storage configuration, comprising:

a) first and second caster assemblies;

b) each caster assembly including:

i) a caster beam member having opposing end portions end a middle portion;

ii) at least one caster mounted adjacent each end portion to support the end portions at a height above a support surface;

iii) wherein said middle portion of said caster beam has a lower height than said end portions;

c) first and second table assemblies, abutting to form a table tennis table in an open configuration;

d) wherein said first and second caster assemblies are arranged at opposing ends of the table abutment;

e) wherein each table assembly is mounted to said first caster assembly and said second caster assembly;

f) a cross-brace extending between said first and second caster assemblies;

g) wherein each caster assembly further comprises an upright beam extending vertically from the middle portion of said caster beam member to adjacent the table abutment; and, h) wherein each table assembly has two rollers mounted adjacent the opposing ends of the table abutment and configured to be received in tracks defined in the upright beams of said caster assemblies.

9. The table tennis table of claim 8 wherein each said caster beam member includes curved portions between said middle portion and said opposing end portions.

10. The table tennis table of claim 9 wherein said curved portions have an "S" profile.

11. The table tennis table of claim 8 wherein each table assembly is pivotally mounted to said first caster assembly and said second caster assembly.

12. The table tennis table of claim 8 wherein each said table assembly includes a leg assembly, and each said log assembly includes at least one interior leg portion configured to attach to one said caster beam member and at least one exterior leg member adjacent an exterior corner of a table assembly, wherein said interior leg portion and said exterior leg member are linked such that collapsing said table from an open configuration to a storage configuration causes said interior leg portion and said exterior leg member to retract parallel to each table assembly.

* * * * *

UNITED STATES PATENT AND TRADEMARK OFFICE

CERTIFICATE OF CORRECTION

PATENT NO. : 6,916,258 B2
DATED : July 12, 2005
INVENTOR(S) : Bemanali H. Dadbeh It is certified that error appears in the above-identified patent and that said Letters Patent is hereby corrected as shown below:

Column 5,
Line 50, replace "tabular" with -- tubular --.

Column 6,
Line 3, replace "team" with -- from --.
Line 12, replace "end" with -- and --.
Line 44, replace "log" with -- leg --.

Signed and Sealed this

Sixth Day of September, 2005

JON W. DUDAS
*Director of the United States Patent and Trademark Office*